US005988668A

United States Patent [19]

DeVille et al.

[11] Patent Number: 5,988,668

[45] **Date of Patent: *Nov. 23, 1999**

[54] SNOWBOARD

[75] Inventors: Dominique DeVille, Annecy Le Vieux; Vincent Forest; Maurice LeGrand, both of Annecy, all of France

[73] Assignee: Salomon S.A., Metz-Tessy, France

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/631,131

[22] Filed: Apr. 12, 1996

Related U.S. Application Data

[63] Continuation of application No. 08/233,747, Apr. 26, 1994, Pat. No. 5,573,264.

[30] Foreign Application Priority Data

Apr. 30, 1993 [FR] France ..... 93 05397

[51] Int. Cl.[6] ..... A63C 5/07

[52] U.S. Cl. ..... 280/602; 280/610; 280/14.2

[58] Field of Search ..... 280/602, 608, 280/609, 607, 610, 601, 11.12, 14.2, 28, 11.18

[56] References Cited

U.S. PATENT DOCUMENTS

| | | | |
|---|---|---|---|
| 2,065,179 | 12/1936 | Fosse | 280/610 |
| 3,015,831 | 1/1962 | Franke | 280/609 |
| 3,352,566 | 11/1967 | Kennedy | 280/610 |
| 3,861,698 | 1/1975 | Greig | 280/11.13 Y |
| 3,900,204 | 8/1975 | Weber | 280/11.13 S |
| 4,405,139 | 9/1983 | Kawahard | 280/14.2 |
| 4,533,150 | 8/1985 | Hardy | 280/14.2 |
| 4,592,567 | 6/1986 | Sartor | 280/602 |
| 4,767,369 | 8/1988 | Snyder | 280/610 |
| 4,974,868 | 12/1990 | Morris | 280/14.2 |
| 5,035,442 | 7/1991 | Anrsteiner | 280/602 |
| 5,096,217 | 3/1992 | Hunter | 280/14.2 |
| 5,141,243 | 8/1992 | Meatto | 280/602 |
| 5,190,311 | 3/1993 | Carpenter | 280/14.2 |
| 5,249,819 | 10/1993 | Mayr | 280/607 |
| 5,251,924 | 10/1993 | Nussbaumer | 280/602 |
| 5,320,378 | 6/1994 | Wiig | 280/610 |
| 5,340,144 | 8/1994 | Eleneke | 280/14.2 |
| 5,342,077 | 8/1994 | Abondance | 280/14.2 |
| 5,366,234 | 11/1994 | Rohrmoser | 280/607 |
| 5,393,085 | 2/1995 | Forneri | 280/602 |
| 5,427,401 | 6/1995 | Liard | 280/602 |
| 5,573,264 | 11/1996 | DeVille | 280/602 |

FOREIGN PATENT DOCUMENTS

| | | | |
|---|---|---|---|
| 2581322 | 11/1986 | France | 280/14.2 |
| 2659246 | 9/1991 | France | 280/14.2 |
| 2659563 | 9/1991 | France | 280/14.2 |
| 2663235 | 12/1991 | France | 280/14.2 |
| 419468 | 4/1924 | Germany | 280/602 |
| 4205381 | 8/1992 | Germany | A63C 5/00 |
| 681061 | 1/1993 | Switzerland | A63C 5/12 |
| WO91/09653 | 7/1991 | WIPO | A63C 5/07 |

*Primary Examiner*—Anne Marie Boehler
*Attorney, Agent, or Firm*—Greenblum & Bernstein P.L.C.

[57] ABSTRACT

The invention concerns a gliding board, especially a snowboard, which is intended to support both boots of a skier. The board includes a base structure of which at least the front end is turned up to form the shovel. It further has a central zone with two mounting zones for the binding elements, a front zone, and a rear zone. The board has, at least in one of the front or rear zones, a long reinforcement shaped according to the length and width of the zone. The reinforcement extends from the vicinity of the end of the front or rear zone to at least the vicinity of the mounting zone located near the zone.

37 Claims, 6 Drawing Sheets

SNOWBOARD

This application is a continuation of application Ser. No. 08/233,747, filed on Apr. 26, 1994, now U.S. Pat. No. 5,573,264, issued on Nov. 12, 1996.

BACKGROUND OF THE INVENTION

1. Field of the Invention

The invention relates to a board for gliding on snow or ice, and especially a snowboard.

2. Discussion of Background and Material Information

Such a board is intended to support both of a skier's boots, which are retained, side by side, by binding elements. Generally, the two boots are offset along the median longitudinal axis of the board, and they are oriented with respect to this axis along an angle varying approximately between 5 and 90 degrees from one side or the other of the longitudinal axis. Usually, this axis is adjustable. Such a gliding apparatus is, for example, described in U.S. Pat. No. 3,900,204.

The invention more specifically pertains to the structure of the gliding board.

It is currently known to produce such boards by implementing construction techniques originating from the conventional ski. Thus, there are snowboards constructed according to a sandwich or box structure.

However, during the glide, the snowboard operates differently from a conventional ski in view of forces imposed on it. Indeed, both of the surfer's boots are retained on the board; in addition, they are retained asymmetrically with respect to the board. Generally, during the glide, the board is subjected to forces greater than those of a normal ski. The surfer has two support points on the board, and, by a differential action of both boots, the surfer acts on the flexion or torsion of his or her board. Finally, the surfer has an asymmetrical position with respect to the board and with respect to the slope. The two lateral edges of the board are not similarly biased.

The flexion and torsion of the board are parameters which influence the maneuverability or operational qualities of the snowboard, as well as the geometrical shapes of the board, mainly length, width and shape of the side cuts.

The weight and general resistance of the board are also parameters which determine the quality of the snowboard.

For a conventionally constructed board, it is very difficult to master each of these parameters in order to obtain the required gliding, maneuverability or operational qualities. Indeed, these parameters are mutually connected, such that the variation of one parameter indirectly modifies the other parameters of the board. Most often, a compromise is adopted.

SUMMARY OF THE INVENTION

One of the objects of the invention is to propose a gilding board for which the construction parameters, especially the flexion and torsion, can be controlled and managed precisely and independently.

Another object of the present invention is to propose a board whose various parameters can be determined with greater freedom.

Another object of the invention is to propose a board for which the parameters can be controlled and managed differently in different zones of the board, especially along each of the two lateral edges.

Other objects and advantages of the invention will become apparent from the following description, this description, however, being provided as a non-limiting example.

The gliding board, especially the snowboard according to the invention, is intended to support both of a surfer's boots which are retained on the board, side by side, by binding elements. It comprises a long base structure, in the shape of a plate, whose front end at least, is turned up to form the shovel, the base structure having a central zone with two mounting zones for the binding elements, the mounting zones of the bindings being located towards the center of the width of the central zone, and being offset with respect to one another along the median longitudinal direction defined by the base structure, the base structure further having a front zone located in front of the central zone, and a rear zone located behind the central zone.

The gliding board according to the invention has, at least in one of the front or rear zones, a long reinforcement which extends along a portion only of the surface of the front or rear zone, from at least the vicinity of the end of the base structure, to at least the vicinity of the mounting zone for the binding element located on the side of said front or rear zone so as to increase the torsional and/or flexional resistance of a surface of the base structure covering the front or rear zone, and at least a portion of said mounting zone.

BRIEF DESCRIPTION OF THE DRAWINGS

The invention will be better understood with reference to the description below, as well as the annexed drawings which are an integral portion thereof.

DETAILED DESCRIPTION OF THE PREFERRED EMBODIMENTS

Figure 1:
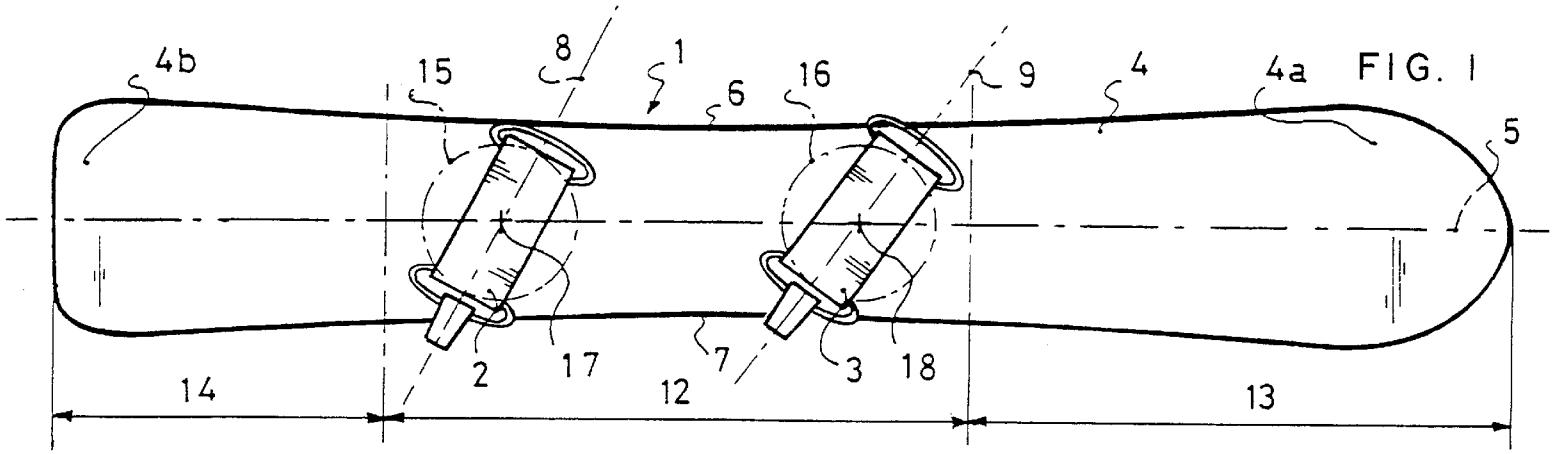
FIG. 1 is a general top view of a snowboard equipped with binding elements.

FIG. 1 represents a top view of a snowboard 1 intended for gliding on snow or ice. In its central zone, snowboard 1 is equipped with retention elements 2 and 3 to retain the surfer's boots side by side.

Snowboard 1 comprises a long base structure 4 in the shape of a plate, generally flat, whose thickness is approximately constant. The base structure shown is symmetrical with respect to a vertical and longitudinal plane whose trace is schematically shown by a longitudinal axis 5 in FIG. 1. This is non-limiting, and as will be described later, the base structure can also have an asymmetrical shape.

Front end 4*a* of base structure 4 is turned up to form the shovel or spatula. In the example shown, rear end 4*b* is located substantially in the same plane as the base structure. This is non-limiting, and the rear end can also be spatulate.

Laterally, base structure 4 has two lateral edges 6 and 7. These lateral edges have an incurved shape along what is commonly known as a side cut. The curvature of the side cuts can be more or less sharp. This is within comprehension of one of ordinary skill in the art. Generally, the minimum width of the base structure is located between the retention elements 2 and 3, and is close to the length of a boot, possibly a bit shorter.

Along the longitudinal axis, snowboard 1 has two retention elements 2 and 3 which are intended to retain the surfer's boots in support on the base structure. These retention elements are of any appropriate type and will not be described in detail. For example, they each have a long plate equipped with two retention stirrups which grasp the boot by its front and rear tips. This is known by one of ordinary skill in the art.

The plates of retention elements 2 and 3 define the orientation of the surfer's boots with respect to longitudinal axis 5 of base structure 4. These orientation directions are schematized along line 8 for element 2, and along line 9 for element 3. Preferably, as is known, the orientation of the retention elements 2 and 3, i.e., of the directions 8 and 9 with respect to the longitudinal axis 5, is adjustable.

Both retention elements 2 and 3 are assembled at base structure 4 in a central zone 12. In front of this central zone, the base structure has a front zone 13 which ends with the spatula. In the rear, the base structure has a rear zone 14.

The retention elements 2 and 3 are assembled in two mounting zones 15 and 16 of central zone 12. The mounting zones of the binding elements are schematized in FIG. 1 in the form of two circles centered at points 17 and 18 located along direction 5, whose diameter is slightly less than the width of the base structure in this area. In fact, the mounting zones correspond to the surface of the base structure covered by the retention elements along their entire adjustment range in longitudinal position, and in orientation with respect to longitudinal direction 5.

Usually, centers 17 and 18 of the mounting zones are 40 to 50 centimeters apart along direction 5. However, this is non-limiting. This distance can also be adjustable. The alignment along direction 5 is also non-limiting, and the mounting zones could be transversely offset with respect to this direction 5.

The base structure has a conventional construction, especially a box or sandwich type structure, or a combination of these two construction types.

During the glide, the base structure is flexionally and torsionally deformed, i.e., bent and twisted in the front, rear and central zones, between the retention elements. In addition, by a differential action of the boots, i.e., by playing on the different kinds of supports on both his or her feet, the surfer can act on the flexion or torsion of the central zone. It is known for example, that an intentional torsion force exerted in the central zone facilitates the turn initiation. Likewise, a flexion of the central zone promotes the effect produced by the front-to-rear movement of the surfer to displace the support zones of the board on the snow. In addition, an intentional flexion face exerted in the central zone before a jump increases the expansion energy which is released during the jump.

According to the invention, the gliding board has a local reinforcement in at least one of the front or rear zones of the base structure. The reinforcement extends along a portion only of the surface of the front and/or rear, and/or central zone from the end or vicinity of the end of the zone, to the mounting zone of the binding element located on the side of the front or rear zone, or the vicinity of this mounting zone. The geometry, stiffness, and position of the reinforcement are determined so as to increase the torsional or flexional stiffness of a surface covering the surface of the front and/or rear zone up to at least the mounting zone of the front and/or rear binding element. That is, the resistance to bending and/or twisting of the snowboard are increased according to the geometry, stiffness, and position of the reinforcement.

Thus, the gliding board is obtained from a base structure of conventional construction, but is substantially more flexible and lighter than a conventional structure. The base structure defines the geometrical shape of the gliding board, i.e., it defines the shape of its periphery, its length, width, the shape of its side cuts, if necessary, the relief of its gliding sole.

The base structure is then reinforced by a reinforcement to thereby form a reinforced base structure assembly. The stiffness, geometry and position of the reinforcement are determined as a function of the desired effect, depending upon whether one wants to torsionally and/or flexionally reinforce the front and/or rear zone, and/or the central zone of the base structure. In this manner, the geometry of the gliding board and its mechanical stiffness characteristics are rendered more independent than in conventional constructions.

According to the invention, it is important that the reinforced surface at least partially cover the mounting zones of the binding elements, so that the surfer can control, and if necessary, pilot the action of the reinforcements on the flexion and/or torsion of the board from his or her boots.

Preferably, the stiffness of the reinforcement is maximum towards the mounting zone located on the side of the zone, and it decreases towards the end of the zone.

Preferably also, between the retention elements, i.e., between the mounting zones, the reinforcement has a relatively lower or zero action, so as to not unduly impede the flexion and torsion of the board in this zone.

The reinforcement is obtained in any appropriate material. For example, it consists of a sheet of high performance aluminum alloy of the type used in the construction of conventional base structures. It can also be obtained from a composite structure of fibers coated with a thermohardenable resin, the fibers being additionally oriented along a defined direction, if necessary. Any other appropriate material is also suitable.

The stiffness of the reinforcement can be determined by the geometry of its contour, mainly its width and thickness, and by the nature and orientation of the material used.

Figure 2:
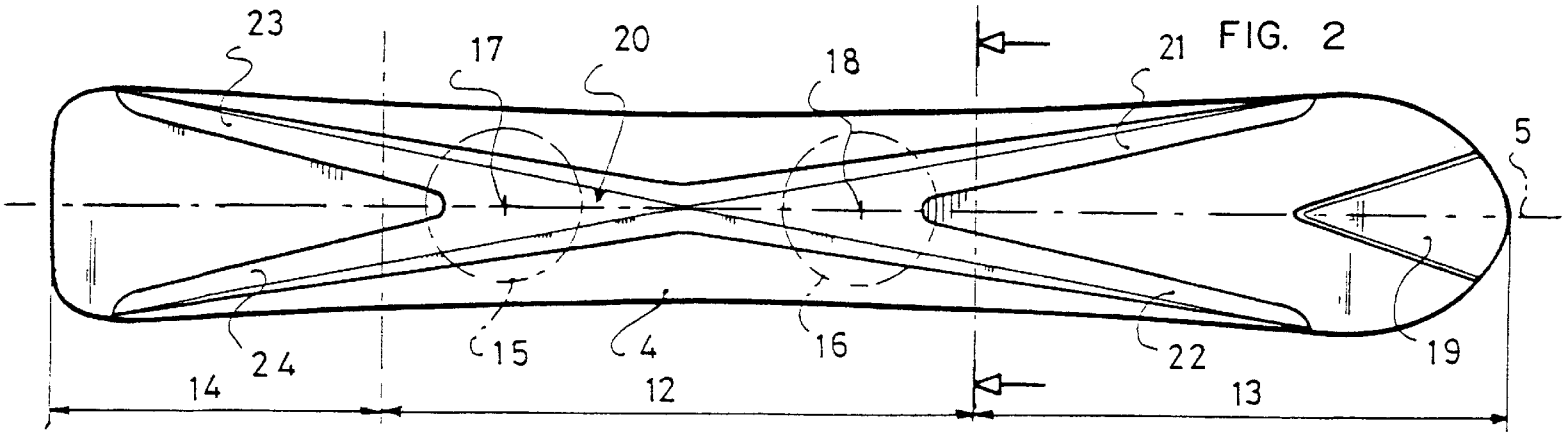
FIG. 2 schematically shows a top view of a gliding board according to a first, non-limiting implementation of the invention.

FIG. 2 schematically illustrates a top view of a first implementation of the invention. According to this implementation, the gliding board has a reinforcement 20 which extends into front zone 13, central zone 12 and rear zone 14. Reinforcement 20 has two branches 21, 22 and 23, 24, in each front or rear zone, which converge from each corner of the front or rear zone towards longitudinal direction 5, in the area of central zone 12.

As is visible in FIG. 2, the width of reinforcement 20 is maximum in the area of mounting zones 15 and 16. From there, the width of the branches decreases in the direction of the ends of the front and rear zones. The width of the reinforcement also has a minimum between mounting zones 15 and 16.

Figure 3:
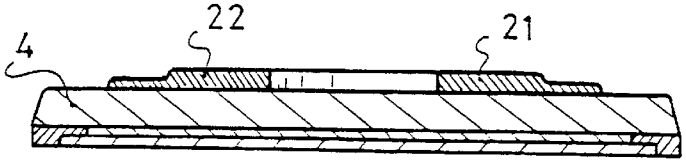
FIG. 3 is a transverse sectional view of the board of FIG. 2.

FIG. 3 represents a section of the gliding board of FIG. 2 in the area of the intersection between zones 12 and 13, in the case where the reinforcement is attached to the top surface of base structure 4. This view illustrates the fact that reinforcement 20 can have a constant thickness, or else, as is represented, it can have a thickness graduated along its width, due to, for example, the local superposition of various reinforcement layers. The thickness can also vary progressively. The reinforcement thickness can vary in the same manner along the length.

Such a reinforcement contour mainly acts on the flexion of the front zone and the rear zone, which is stiffer. On the other hand, the gliding board maintains a certain torsional flexibility. This flexibility is mainly concentrated in central zone 12. Therefore, the gliding board has a twisting ability that promotes the turn initiation. On the other hand, the reinforcement provides the board ends with a stable support.

Possibly, the board can also have a secondary reinforcement 19 on the front, in the shape of a triangle, whose tip is engaged between branches 21 and 22 of reinforcement 20. Such a secondary reinforcement flexionally reinforces the spatula of the board.

Figure 4:
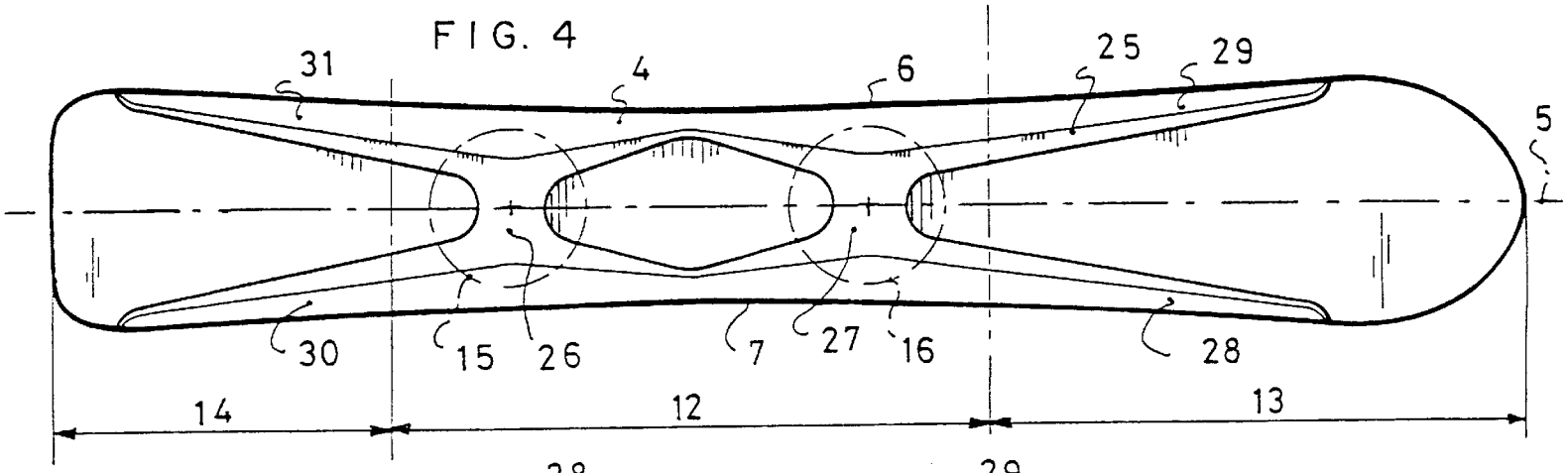
FIGS. 4 and 6 are views similar to FIG. 2 which illustrate other implementations of the invention.

FIG. 4 illustrates another embodiment of the invention. According to this variation, the gliding board has a reinforcement 25, shaped according to the length and width of the board. Reinforcement 25 mainly extends along the lateral edges 6 and 7 of the board. Especially in front zone 13 and rear zone 14, reinforcement 25 has two branches 28 and 29, 30 and 31 which extend along the lateral edges of the base structure. Between the mounting zones, the branches 28 and 30, 29 and 31 extend continuously along the lateral edges of structure 4. In the area of the front and rear mounting zones 16 and 15, reinforcement 25 has two bridging connections 26 and 27. The reinforcement extends along the entire width of the board locally in these zones.

Reinforcement 25 thus has a maximum width towards the front and rear mounting zones 15 and 16. The width of the branches then decreases towards the ends of the front and rear zones. Between the mounting zone 15 and 16, the reinforcement has a relative minimum width.

Figure 5:
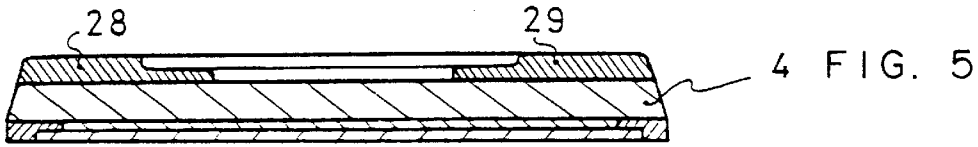
FIG. 5 is a transverse sectional view of the board of FIG. 4.

The thickness of reinforcement 25 can be constant along its width or vary progressively, or else, as represented in FIG. 5, vary in a graduated manner. Such a progressive or graduated variation of thickness can also play in the direction of the length.

Such a reinforcement mainly reinforces the torsional stiffness of the front, rear, and central zones. However, the reinforcement action is relatively less between the mounting zones 15 and 16. The reinforcement is mainly active along the lateral edges of the board, it especially renders the board more stable during operation, and provides it with a better grip in the turns.

Figure 6:
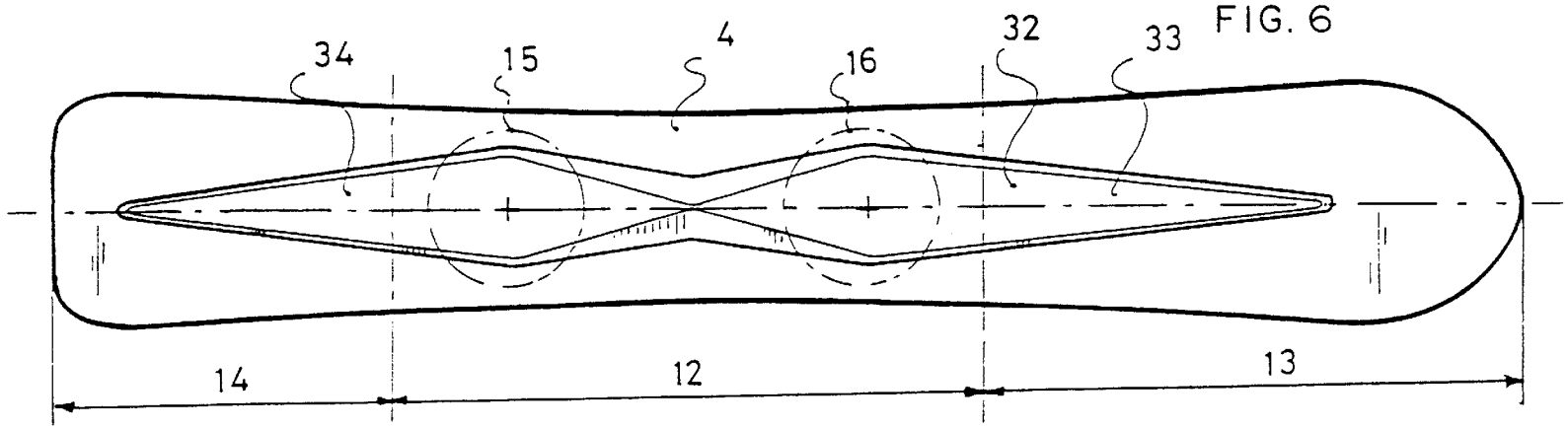

FIG. 6 illustrates another embodiment of the invention. According to this variation, the gliding board has a reinforcement 32, shaped according to the length and width of the board. Reinforcement 32 extends into front and rear zones 13 and 14, and into central zone 12 along longitudinal direction 5. As is represented in the figure, reinforcement 32 has branches 33, 34 in the front and rear zones, respectively. The branches extend continuously into central zone 12. The width of reinforcement 32 is maximum towards the front and rear mounting zones 15 and 16. It decreases towards the ends of the front and rear zones. Between the mounting zones 15 and 16, the width of reinforcement 32 decreases progressively and has a minimum.

As in the previous cases, the thickness of reinforcement 32 can be constant, or can vary progressively or in a graduated manner along the length and width of the reinforcement.

Reinforcement 32 mainly exerts an action on the flexional stiffness of the front and rear zones of the base structure. Furthermore, the base structure maintains a relatively high torsional flexibility along its entire length.

Figure 7:
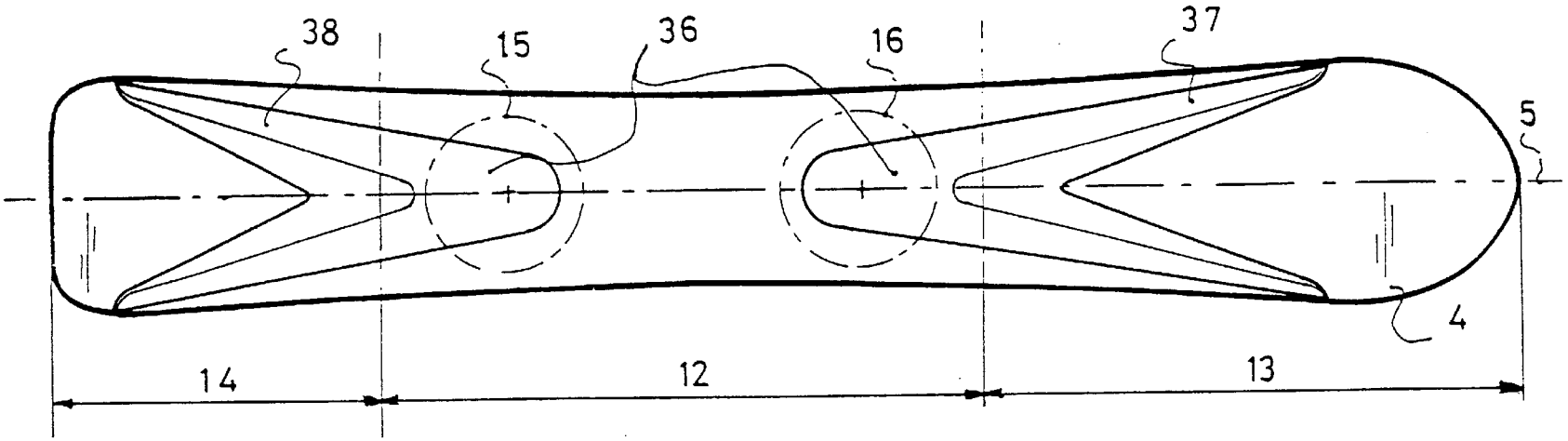
FIGS. 7, 8, 9, 10, 11 and 12 illustrate implementation variations of the invention.

FIG. 7 illustrates another implementation of the invention. According to this figure, reinforcement 36 is constituted by front and rear portions 37 and 38.

The front and rear portions 37 and 38 include two convergent branches that extend from the corners of the front and rear zones towards direction 5. FIG. 7 shows that the reinforcement portions 37 and 38 extend to the central zone 12, and that they have a zone of intersection with the front and rear mounting zones 15 and 16.

Generally, this reinforcement has the same shape as that described in relation to FIG. 2. However, reinforcement 36 has a discontinuity zone between the mounting zones 15 and 16. In the present case, with respect to the gliding board shown in FIG. 2, the present board has an accrued flexibility in its central zone 12, more especially between the boot retention elements.

Figure 8:
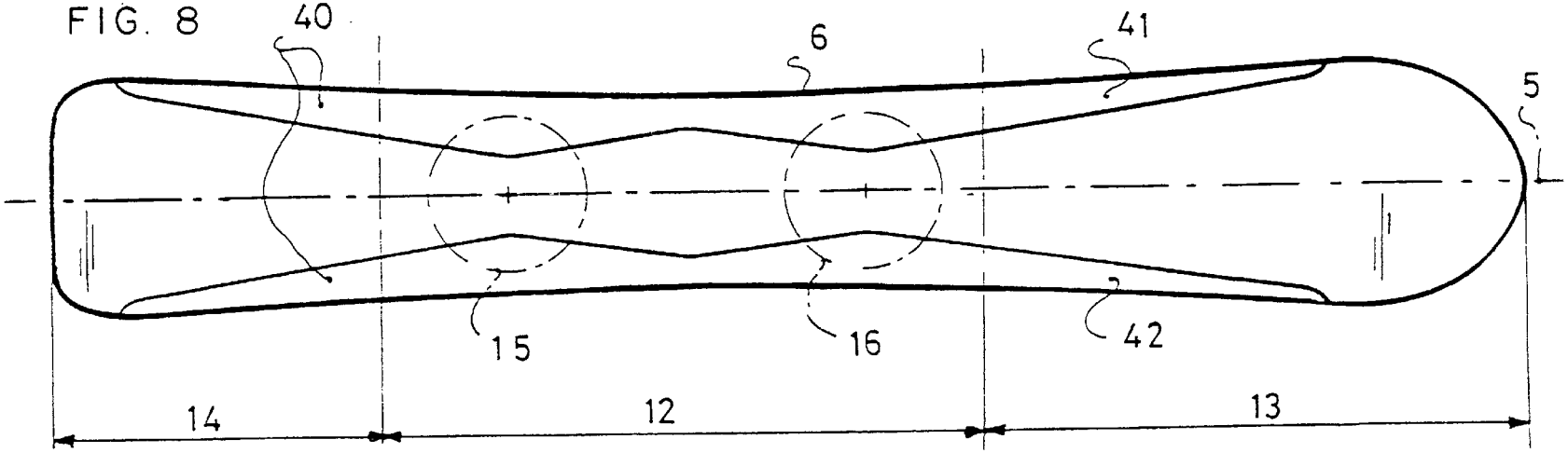

FIG. 8 shows another implementation of the invention. According to this variation, the gliding board has a reinforcement 40 in two parts 41 and 42 which extend respectively along the two lateral edges of the board.

Reinforcement 40 has geometric characteristics that are close to those described in relation to FIG. 4, however, with a discontinuity along longitudinal direction 5.

Figure 9:
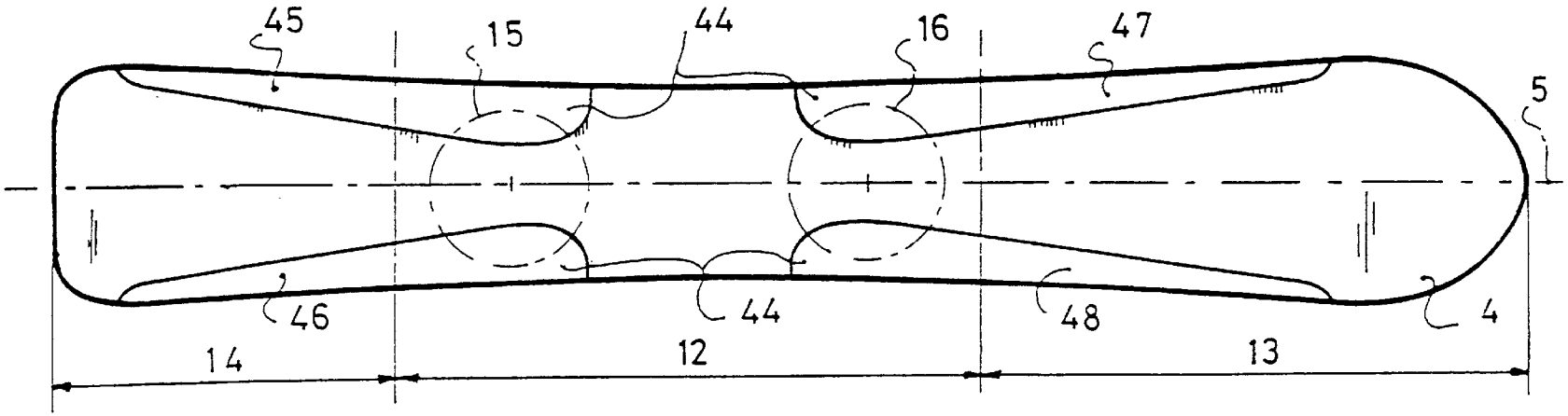

FIG. 9 shows another variation according to which, in addition to a longitudinal discontinuity, the reinforcement 44 has a transverse discontinuity between the mounting zones 15 and 16. Thus, reinforcement 44 comprises four branches 45 to 48 which extend mainly along the lateral edges of the gliding board in the front and rear zones. Generally, reinforcement 44 has a maximum width towards the mounting zones 15 and 16. This width decreases towards the front and rear ends of the board.

Figure 10:
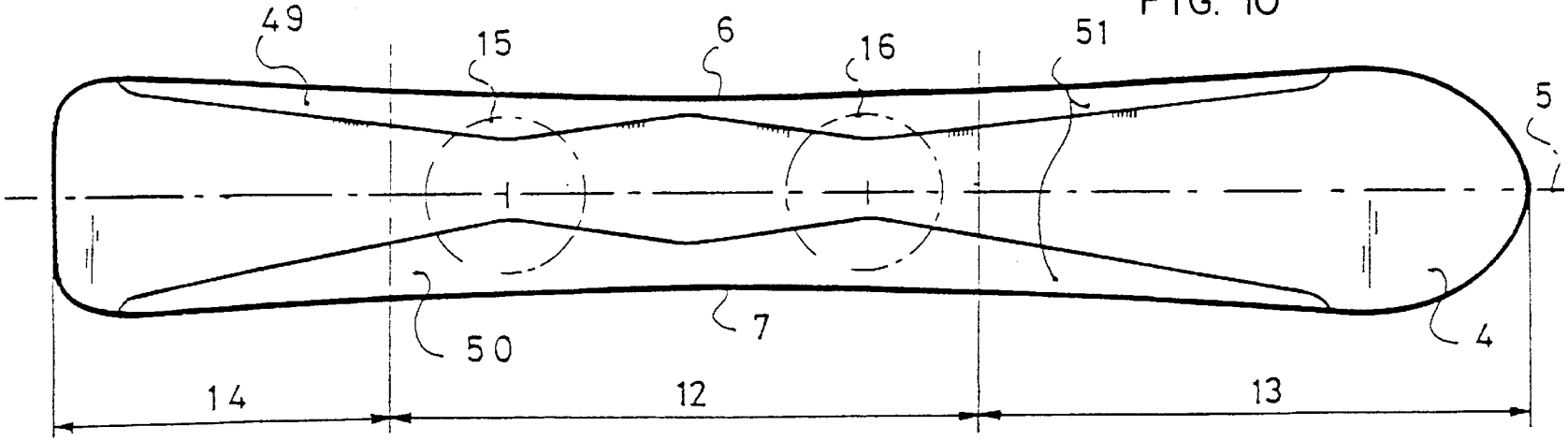

FIG. 10 illustrates another implementation of the invention according to which the reinforcement generally has a greater width or stiffness on one side of axis 5.

Thus, FIG. 10 has a reinforcement 51 of the same nature as reinforcement 40 described in FIG. 8. Reinforcement 51 has two parts 49 and 50 located along the lateral edges of the board, on either side of longitudinal axis 5. The part 50 along edge 7 generally has a greater width and therefore a greater stiffness, at least locally, i.e., at least with regard to any transverse section of the base structure, than that of part 49 along edge 6. This asymmetry reinforces the stiffness of one lateral edge with respect to the other, and takes into account, for example, the asymmetrical position of the surfer on his or her board.

Figure 11:
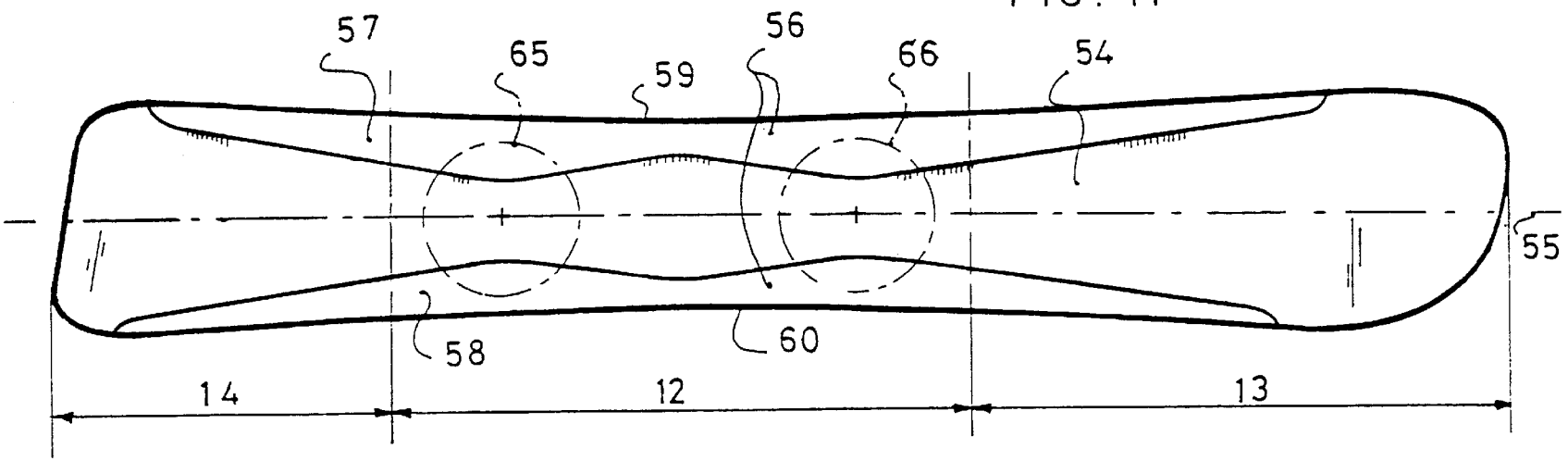

FIG. 11 shows another implementation of the invention according to which base structure 54 has an asymmetrical shape which is adapted to the asymmetrical position of the surfer on his or her board. This asymmetry corresponds to one of the two positions usually known by the names "goofy" or "regular". In a known manner, it can play in the shape of the front and rear ends as well as in the shape and relative position of the side cuts. Compared to the previous structure 4, structure 54 has a median longitudinal direction 55.

FIG. 11 shows a reinforcement 56 of the same nature as the previous reinforcement 51 whose two parts 57 and 58 have proportions and positions in relation with the asymmetry of structure 54. Thus, the board shown in FIG. 11 has a lateral edge 59 offset frontwardly with respect to edge 60.

Similarly, part 57 of the reinforcement is offset frontwardly with respect to part 58. The shape and stiffness of the reinforcement can also be different on parts 57 and 58, relative to the asymmetry of base structure 54.

However, as in the previous cases, the width of reinforcement 56 is maximum towards the mounting zones of bindings 65 and 66, and decreases progressively towards the ends of the front and rear zones.

Figure 12:
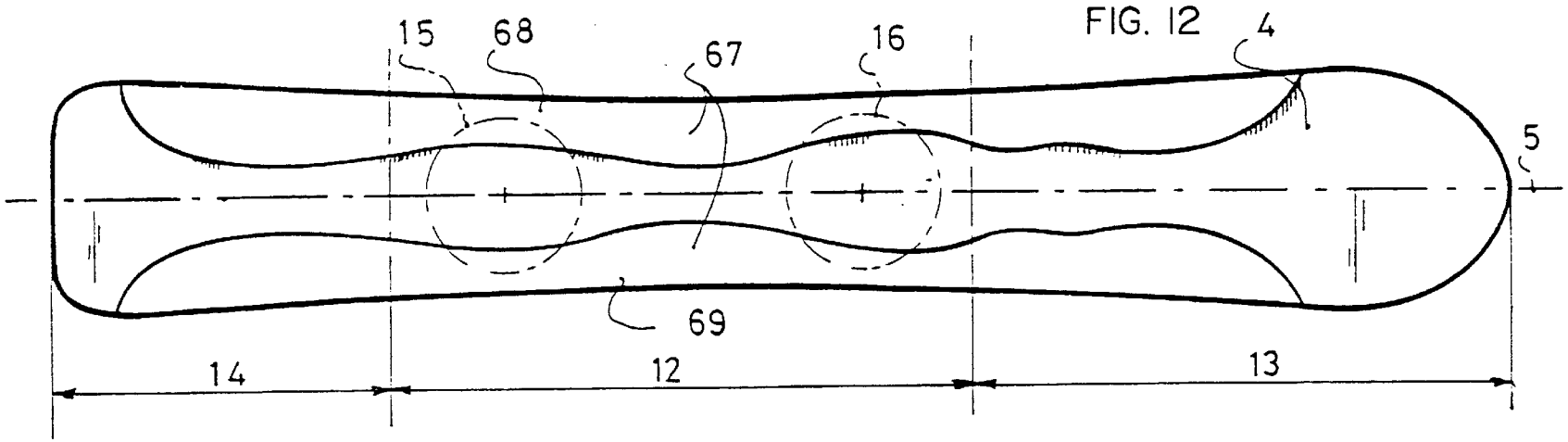

FIG. 12 illustrates another variation, according to which the gliding board has a reinforcement 67 in two parts 68 and 69 located on either side of the median longitudinal axis 5. The width of parts 68 and 69 increases from each of the ends of the front and rear zones, and has local fluctuations in the center, especially in the area of mounting zones 15 and 16. Such local fluctuations can also be present on the thickness of the reinforcement.

Figure 13:
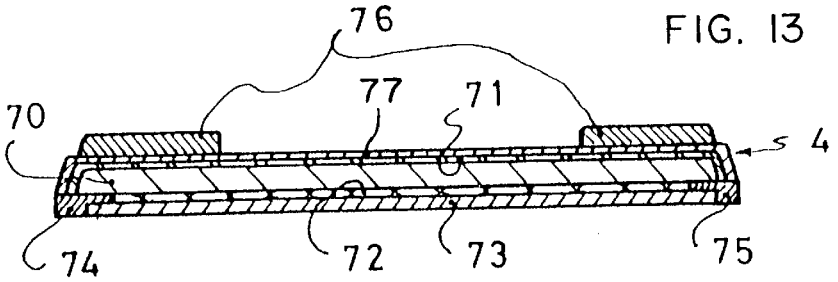
FIG. 13 is transverse sectional view of a gliding board, and illustrates the positioning of the reinforcement on the base structure according to a first, non-limiting implementation.

FIG. 13, in transverse section a first embodiment of the gliding board. According to this embodiment, base structure 4 has a conventional construction, such as a box type structure with a central core 70, for example, enveloped on the top and sides by a reinforcement layer 71. In its bottom portion, the structure has a lower reinforcement layer 72 located between the two lateral running edges 74 and 75, and a sole layer 73 under layer 72. The structure is covered by a decorative layer 77 in its top portion.

According to the embodiment of FIG. 13, reinforcement 76 is attached to the top surface of base structure 4, i.e., above of the decorative layer. The reinforcement is assembled by any means appropriate to its nature, especially adhesion, welding, mechanical assembly.

Figure 14:
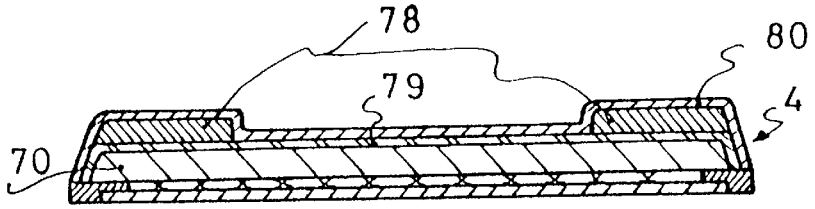
FIGS. 14, 15, 16, 17 and 18 illustrate variations of the positioning of the reinforcement on the base structure.

FIG. 14 illustrates a variation according to which reinforcement 78 is assembled at the top surface of upper reinforcement layer 79, and the assembly is covered by decorative layer 80. Between the branches of reinforcement 78, the decorative layer is flush with the top surface of the upper reinforcement layer.

Figure 15:
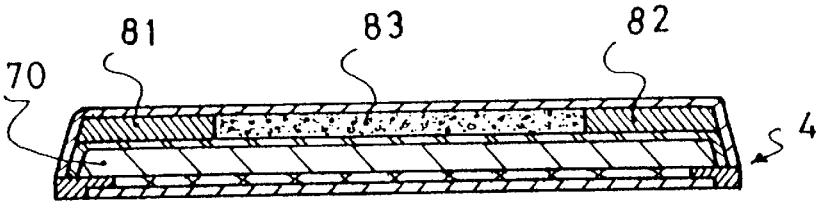

FIG. 15 illustrates another variation according to which space 83 between reinforcement branches 81 and 82 is filled with a low modulus padding material, i.e., which has a negligible influence on the thickness of the assembly. The assembly is covered by the decorative layer.

Figure 16:
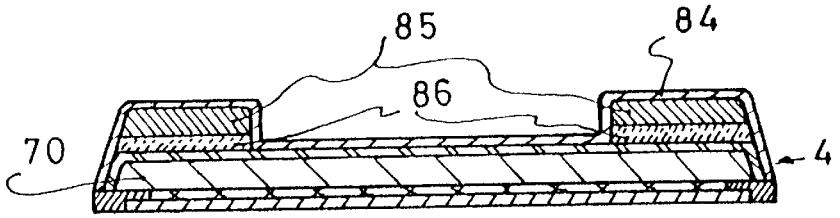

FIG. 16 represents another variation according to which a layer of deformable material 86 is inserted between reinforcement 85 and the base structure. This material, for example, has shock absorbing characteristics of the viscoelastic type. It could also be a material which has the ability to be deformed by stretching or shearing while absorbing energy. Such a material, such as rubber, for example, is known by one of ordinary skill in the art.

As in the case of FIGS. 13 and 14, decorative layer 84 covers the base structure, including reinforcement 85.

Figure 17:
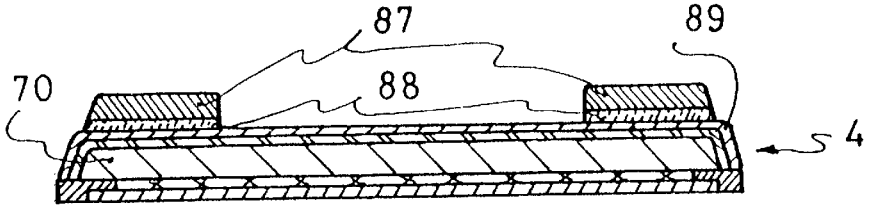

FIG. 17 shows a variation of the same type, with the slight difference that reinforcement 87 and deformable layer 88 are assembled at the top the surface of decorative layer 89.

Figure 18:
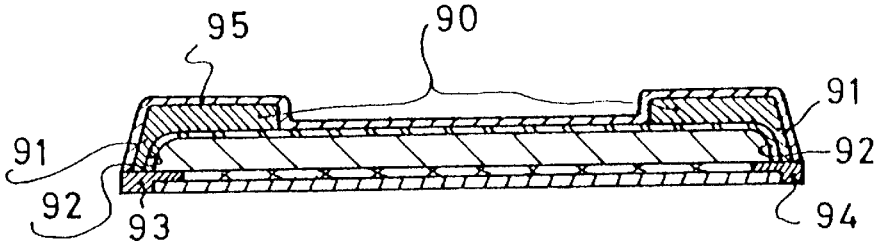

FIG. 18 illustrates another variation according to which reinforcement 90 extends, at least locally, along the sides of the base structure, up to the lateral running edges. In other words, in the zones where the reinforcement extends along the lateral edges of the base structure, it has, at least locally, extensions 91 which cover sides 92 of the base structure up to lateral running edges 93, 94. In the embodiment illustrated, a decorative layer 95 covers the assembly. This is non-limiting, and, as in the case of FIGS. 13 and 17, the reinforcement could be mounted above the decorative layer.

These embodiments have the advantage of originating from a base structure of the conventional type, whose torsional and flexional stiffnesses are then defined according to the geometry of the reinforcement material as a function of the type of gliding board desired.

Other embodiments are also possible. In particular, the reinforcement can be incorporated right within the base structure, or at the level of its gliding surface.

Naturally, the present description is only given as an example and one could adopt other implementations of the invention without departing from the scope thereof.

In particular, it goes without saying that one could provide only one front or rear zone with the different reinforcement geometries described.

It is also possible to use different reinforcement geometries for the front and rear zones, for example, by using for the front zone, a "V"-shaped geometry of the type of that of FIG. 3, and an "I"-shaped geometry for the rear zone of the type of FIG. 4. Numerous combinations of this type are possible.

The instant application is based upon French patent application 93.05397 of Apr. 30, 1993, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed:

1. A snowboard adapted to support a user's feet which are to be retained on the snowboard by longitudinally spaced apart binding elements, said snowboard comprising:

a longitudinally elongated base structure defining a geometrical periphery of the snowboard, said periphery having a length and a width, said base structure having a front end, a rear end, a sole layer forming a bottom, and an upwardly turned shovel at said front end of said base structure;

said base structure further comprising a central zone, a front zone and a rear zone, said front zone being located longitudinally forwardly of said central zone, said rear zone being located longitudinally rearwardly of said central zone;

said central zone containing two longitudinally spaced apart mounting zones for having attached to said mounting zones respective ones of said binding elements;

at least one longitudinally elongated reinforcement permanently fixed against movement with respect to said base structure, said at least one longitudinally extending reinforcement extending from the vicinity of at least one of said front end and said rear end of said base structure to at least one of said mounting zones to thereby form at least one reinforced base structure surface extending from the vicinity of at least one of said front end and said rear end of said base structure to at least one of said mounting zones, said longitudinally elongated reinforcement further extending between said mounting zones, said longitudinally elongated reinforcement being positioned no lower than said bottom, said reinforcement extending over less than said length of said geometrical periphery of said base structure; and said longitudinally elongated reinforcement comprising a stiffness between said mounting zones that is less than a stiffness between said one of said mounting zones and said one of said front end and said rear end of said base structure.

2. A snowboard according to claim 1, wherein:

said reinforcement comprises a longitudinally variable stiffness, said stiffness decreasing in a direction from said one of said mounting zones toward said one of said front end and said rear end of said base structure.

3. A snowboard according to claim 1, wherein:

said base structure further comprises a pair of longitudinally extending lateral edges; and said at least one reinforcement comprises a pair of branches, each of said pair of branches extending from at least one of said front end and said rear end of said base structure along respective ones of said lateral edges of said base structure to at least one of said mounting zones.

4. A snowboard according to claim 1, wherein:

said base structure further comprises a pair of laterally opposed front corners and a pair of laterally opposed rear corners; and said at least one reinforcement comprises a pair of longitudinally extending branches converging from the vicinity of said pair of laterally opposed front corners to at least one of said mounting zones and a pair of longitudinally extending branches converging from the vicinity of said pair of laterally opposed rear corners to at least one of said mounting zones.

5. A snowboard according to claim 1, wherein:

said at least one reinforcement longitudinally extends into at least one of said front zone and said rear zone along a longitudinal median plane of said base structure.

6. A snowboard according to claim 1, wherein:

said at least one reinforcement longitudinally extends continuously into front zone, said central zone, and said rear zone; and said at least one reinforcement comprises a discontinuity along a longitudinal median plane of said base structure.

7. A snowboard according to claim 1, wherein:

said at least one reinforcement comprises a stiffness that varies longitudinally.

8. A snowboard according to claim 1, wherein:

said at least one reinforcement comprises two symmetrical parts located on either side of a longitudinal median plane of said base structure.

9. A snowboard according to claim 1, wherein:

said base structure has an asymmetrical shape with respect to a longitudinal median plane; and said at least one reinforcement comprises two asymmetrical parts whose asymmetry is in relation to said asymmetrical shape of said base structure.

10. A snowboard according to claim 1, wherein:

said at least one reinforcement comprises two parts located on either side of a longitudinal median plane of said base structure; and one of said two parts has a width less than another of said two parts, at least with regard to a transverse section of said base structure.

11. A snowboard according to claim 1, wherein:

said base structure comprises a top surface; and said at least one reinforcement is affixed to said top surface of said base structure.

12. A snowboard according to claim 11, wherein:

said at least one reinforcement comprises two parts located on either side of a longitudinal median plane of said base structure, thereby defining a space between said parts; and said space between said parts is at least partially filled by a low modulus padding material.

13. A snowboard according to claim 1, wherein:

a layer of deformable material is located between said at least one reinforcement and said base structure.

14. A snowboard according to claim 1, wherein:

said base structure further comprises lateral running edges; and said at least one reinforcement comprises two parts located on either side of a longitudinal median plane of said base structure, each of said parts comprises a first portion extending in a lateral direction toward a side of said base structure, and a second portion comprising an extension extending downwardly at the side of said base structure toward one of said lateral running edges.

15. A snowboard according to claim 1, wherein:

said reinforcement is non-unitary with said base structure.

16. A snowboard according to claim 15, wherein:

said reinforcement comprises an aluminum alloy.

17. A snowboard according to claim 15, wherein:

said reinforcement comprises a composite material comprising fibers coated with a thermohardenable resin.

18. A snowboard according to claim 1, wherein:

said at least one longitudinally elongated reinforcement extends through at least one of said mounting zones.

19. A snowboard according to claim 1, wherein:

said binding elements have respective centers, said centers of said binding elements being longitudinally spaced apart by approximately 40–50 centimeters.

20. A snowboard according to claim 1, wherein:

said base structure is generally flat.

21. A snowboard according to claim 1, wherein:

said base structure includes a core; and said reinforcement is positioned above said core.

22. A snowboard according to claim 1, wherein:

said base structure has a generally constant thickness along said length.

23. A snowboard according to claim 1, wherein:

said reinforcement is affixed directly to said base structure along a length of said reinforcement.

24. A snowboard adapted to support a user's feet which are to be retained on the snowboard by longitudinally spaced apart binding elements, said snowboard comprising:

a longitudinally elongated base structure defining a geometrical periphery of the snowboard, said periphery having a length and a width, said base structure having a front end, a rear end, a sole layer forming a bottom, and an upwardly turned shovel at said front end of said base structure;

said base structure further comprising a central zone, a front zone and a rear zone, said front zone being located longitudinally forwardly of said central zone, said rear zone being located longitudinally rearwardly of said central zone;

said central zone containing two longitudinally spaced apart mounting zones for having attached to said mounting zones respective ones of said binding elements;

at least one longitudinally elongated reinforcement extending from the vicinity of at least one of said front end and said rear end of said base structure to at least one of said mounting zones to thereby form at least one reinforced base structure surface extending from the vicinity of at least one of said front end and said rear end of said base structure to at least one of said mounting zones, said longitudinally elongated reinforcement further extending between said mounting zones, said longitudinally elongated reinforcement being positioned no lower than said bottom, said reinforcement extending over less than said length of said geometrical periphery of said base structure;

said at least one reinforcement longitudinally extending into at least one of said front zone and said rear zone and comprising a discontinuity between said mounting zones; and said longitudinally elongated reinforcement comprising a stiffness between said mounting zones that is less than a stiffness between said one of said mounting zones and said one of said front end and said rear end of said base structure.

25. A snowboard adapted to support a user's feet which are to be retained on the snowboard by longitudinally spaced apart binding elements, said snowboard comprising:

a longitudinally elongated base structure defining a geometrical periphery of the snowboard, said periphery having a length and a width, said base structure having a front end, a rear end, a sole layer forming a bottom, and an upwardly turned shovel at said front end of said base structure;

said base structure further comprising a central zone, a front zone and a rear zone, said front zone being located longitudinally forwardly of said central zone, said rear zone being located longitudinally rearwardly of said central zone;

said central zone containing two longitudinally spaced apart mounting zones for having attached to said mounting zones respective ones of said binding elements;

at least one longitudinally elongated reinforcement extending from the vicinity of at least one of said front end and said rear end of said base structure to at least one of said mounting zones to thereby form at least one reinforced base structure surface extending from the vicinity of at least one of said front end and said rear end of said base structure to at least one of said mounting zones, said longitudinally elongated reinforcement further extending between said mounting zones, said longitudinally elongated reinforcement being positioned no lower than said bottom, said reinforcement extending over less than said length of said geometrical periphery of said base structure;

said at least one reinforcement longitudinally comprising a pair of longitudinally extending branches, said branches being connected in a continuous manner by at least one bridging connection having a common surface with at least one of said mounting zones; and said longitudinally elongated reinforcement comprising a stiffness between said mounting zones that is less than a stiffness between said one of said mounting zones and said one of said front end and said rear end of said base structure.

26. A snowboard adapted to support a user's feet which are to be retained on the snowboard by longitudinally spaced apart binding elements, said snowboard comprising:

a longitudinally elongated base structure defining a geometrical periphery of the snowboard, said periphery having a length and a width, said base structure having a front end, a rear end, a sole layer forming a bottom, and an upwardly turned shovel at said front end of said base structure;

said base structure further comprising a central zone, a front zone and a rear zone, said front zone being located longitudinally forwardly of said central zone, said rear zone being located longitudinally rearwardly of said central zone, said base structure comprising a thickness between a top surface and a bottom surface;

said central zone containing two longitudinally spaced apart mounting zones for having attached to said mounting zones respective ones of said binding elements;

at least one longitudinally elongated reinforcement extending from the vicinity of at least one of said front end and said rear end of said base structure to at least one of said mounting zones to thereby form at least one reinforced base structure surface extending from the vicinity of at least one of said front end and said rear end of said base structure to at least one of said mounting zones, said longitudinally elongated reinforcement further extending between said mounting zones, said longitudinally elongated reinforcement being positioned no lower than said bottom, said reinforcement extending over less than said length of said geometrical periphery of said base structure and being incorporated within said thickness of said base structure; and said longitudinally elongated reinforcement comprising a stiffness between said mounting zones that is less than a stiffness between said one of said mounting zones and said one of said front end and said rear end of said base structure.

27. A snowboard adapted to support a user's feet which are to be retained on the snowboard by longitudinally spaced apart binding elements, said snowboard comprising:

a longitudinally elongated base structure defining a geometrical shape of the snowboard, said shape having a length and a width, said base structure having a front end, a rear end, a sole layer forming a bottom, and an upwardly turned shovel at said front end of said base structure;

said base structure further comprising a central zone, a front zone and a rear zone, said front zone being located longitudinally forwardly of said central zone, said rear zone being located longitudinally rearwardly of said central zone;

said central zone containing two longitudinally spaced apart mounting zones for having attached to said mounting zones respective ones of said binding elements;

at least one longitudinally elongated reinforcement permanently fixed against movement with respect to said base structure, said at least one longitudinally extending reinforcement extending from the vicinity of at least one of said front end and said rear end of said base structure to at least one of said mounting zones to thereby form at least one reinforced base structure surface extending from the vicinity of at least one of said front end and said rear end of said base structure to at least one of said mounting zones, said longitudinally elongated reinforcement further extending between said mounting zones, said longitudinally elongated reinforcement being positioned no lower than said bottom, said reinforcement extending over less than said length of said geometrical shape of said base structure;

said at least one longitudinally elongated reinforcement comprising means for increasing at least one of torsional resistance and flexional resistance of said base structure; and said longitudinally elongated reinforcement conferring a stiffness between said mounting zones that is less than a stiffness between said one of said mounting zones and said one of said front end and said rear end of said base structure.

28. A snowboard according to claim 27, wherein:

said longitudinally elongated reinforcement comprises at least one longitudinal branch that has a width that increases in a longitudinal direction within said central zone either from said front end or from said rear end and that decreases between said mounting zones.

29. A snowboard according to claim 28, wherein:

said longitudinally elongated reinforcement comprises a longitudinal branch on each of opposite sides of said base structure and at least one bridging connection between said longiudinal branches.

30. A snowboard according to claim 27, wherein:

said base structure is generally flat.

31. A snowboard according to claim 27, wherein:

said reinforcement is affixed directly to said base structure along a length of said reinforcement.

32. A snowboard adapted to support a user's feet which are to be retained on the snowboard by longitudinally spaced apart binding elements, said snowboard comprising:

a longitudinally elongated base structure defining a geometrical periphery of the snowboard, said periphery having a length and a width, said base structure having a front end, a rear end, a sole layer forming a bottom, and an upwardly turned shovel at said front end of said base structure;

said base structure further comprising a central zone, a front zone and a rear zone, said front zone being located longitudinally forwardly of said central zone, said rear zone being located longitudinally rearwardly of said central zone;

said central zone containing two longitudinally spaced apart mounting zones for having attached to said mounting zones respective ones of said binding elements;

at least one longitudinally elongated reinforcement extending from the vicinity of at least one of said front end and said rear end of said base structure to at least one of said mounting zones to thereby form at least one reinforced base structure surface extending from the vicinity of at least one of said front end and said rear end of said base structure to at least one of said mounting zones, said longitudinally elongated reinforcement further extending between said mounting zones, said longitudinally elongated reinforcement being positioned no lower than said bottom, said reinforcement extending over less than said length of said geometrical periphery of said base structure;

said at least one reinforcement longitudinally extending into said front zone and into said rear zone and comprising a discontinuity between said mounting zones; and said longitudinally elongated reinforcement comprising a stiffness between said mounting zones that is less than a stiffness between said one of said mounting zones and said one of said front end and said rear end of said base structure.

33. A snowboard adapted to support a user and adapted to have affixed thereto longitudinally spaced apart binding elements to retain a user's feet on the snowboard, said snowboard comprising:

a longitudinally elongated base structure defining a geometrical shape of the snowboard, said shape including a length and width, said base structure having a sole, a rear end, and a front end;

said base structure further comprising a central zone, a front zone and a rear zone, said front zone being located longitudinally forwardly of said central zone, said rear zone being located longitudinally rearwardly of said central zone;

said central zone containing two longitudinally spaced apart mounting zones adapted to have attached to said mounting zones respective ones of said binding elements;

at least one longitudinally elongated reinforcement, separate from but permanently affixed against movement with respect to said base structure, extending from the vicinity of at least one of said front end and said rear end of said base structure to at least one of said mounting zones, including a position within at least one of said mounting zones is adapted to have a respective one of said binding elements positioned over said reinforcement, at least one reinforced base structure assembly thereby being formed extending from the vicinity of at least one of said front end and said rear end of said base structure to at least one of said mounting zones; and said longitudinally elongated reinforcement having a geometry, stiffness, and position to confer to said reinforced base structure assembly a resistance to flexion and torsion between said mounting zones that is less than a resistance to flexion and torsion between said one of said mounting zones and said one of said front end and said rear end of said base structure.

34. A snowboard according to claim 33, wherein:

said base structure has a pair of side cuts, thereby defining a smaller width proximate said central zone than proximate said front and rear zones.

35. A snowboard according to claim 33, wherein:

said base structure has a generally constant thickness along said length.

36. A snowboard according to claim 33, wherein:

said base structure includes a core; and said reinforcement is positioned above said core.

37. A snowboard according to claim 33, wherein:

said reinforcement is affixed directly to said base structure along a length of said reinforcement.

* * * * *